US006235635B1

(12) United States Patent
Roy

(10) Patent No.: US 6,235,635 B1
(45) Date of Patent: May 22, 2001

(54) LINEAR CMP TOOL DESIGN USING IN-SITU SLURRY DISTRIBUTION AND CONCURRENT PAD CONDITIONING

(75) Inventor: Sudipto Ranendra Roy, Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 0 days.

(21) Appl. No.: 09/195,654

(22) Filed: Nov. 19, 1998

(51) Int. Cl.[7] ..... H01L 21/302
(52) U.S. Cl. ..... 438/691; 438/692; 451/259
(58) Field of Search ..... 438/689–690, 438/691, 692, 693; 451/259; 156/345

(56) References Cited

U.S. PATENT DOCUMENTS

| | | | | |
|---|---|---|---|---|
| 5,650,039 | | 7/1997 | Talieh | 156/636.1 |
| 5,688,360 | | 11/1997 | Jairath | 156/345 |
| 5,690,544 | * | 11/1997 | Sakurai | 451/444 |
| 5,709,593 | | 1/1998 | Guthrie et al. | 451/287 |
| 5,755,614 | * | 5/1998 | Adams et al. | 451/60 |
| 5,775,983 | | 7/1998 | Shendon et al. | 451/444 |
| 5,782,675 | | 7/1998 | Southwick | 451/56 |
| 5,785,585 | | 7/1998 | Manfredi et al. | 451/288 |
| 5,792,709 | | 8/1998 | Robinson et al. | 438/692 |
| 5,804,507 | * | 9/1998 | Perlov et al. | 438/692 |
| 5,811,355 | * | 9/1998 | Jordan | 438/692 |
| 5,827,115 | * | 10/1998 | Shimizu | 451/123 |

* cited by examiner

*Primary Examiner*—Benjamin L. Utech
*Assistant Examiner*—Kin-Chan Chen
(74) *Attorney, Agent, or Firm*—George O. Saile; Rosemary L. S. Pike

(57) ABSTRACT

An apparatus for multiple component slurry distribution during semiconductor wafer polishing operations. Concurrent polishing pad conditioning is obtained by means of a novel polishing pad design where polishing pads are mounted in a cylindrical configuration as opposed to the conventional flat surface configuration. A polishing pad conditioner is provided to refurbish the polishing pad.

15 Claims, 3 Drawing Sheets

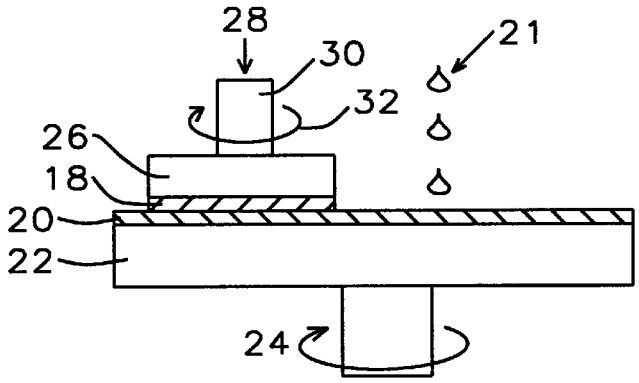
FIG. 1 – Prior Art
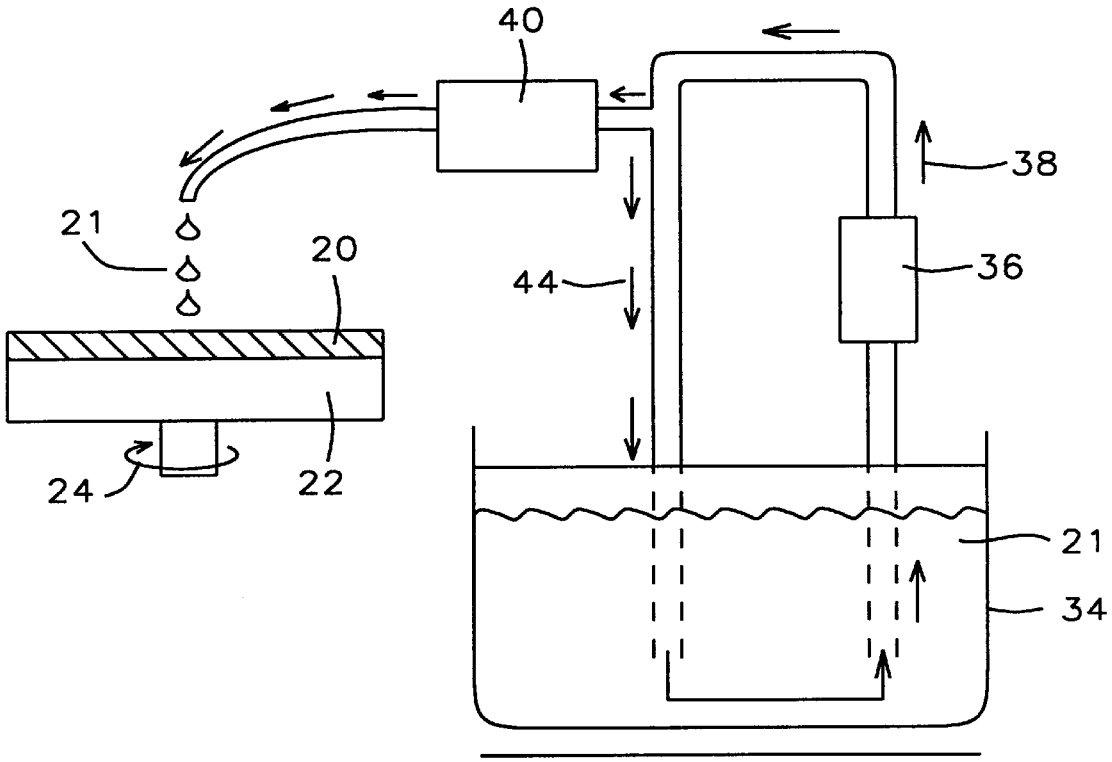
FIG. 2 – Prior Art 51
52
53
54
56
57
58
60
62
64
66
68
70
72
74
76
78
80
82
84
86
50

LINEAR CMP TOOL DESIGN USING IN-SITU SLURRY DISTRIBUTION AND CONCURRENT PAD CONDITIONING

FIELD OF THE INVENTION

The present invention relates to the field of Chemical Mechanical Polishing (CMP). More particularly, the present invention relates to methods and apparatus for chemical mechanical polishing of substrates, such as semiconductor substrates, on a rotating polishing pad in the presence of a chemically and/or physically abrasive slurry, and providing fresh supply of slurry onto the surface of the substrate which is mounted on the polishing pad while the substrate is being polished. Additionally, the present invention includes a pad conditioning apparatus to condition the polishing pad while the polishing pad is being used to polish semiconductor substrates. Additionally, the present invention includes a new slurry delivery system where multi-component slurries can be used that can be metered very accurately during slurry flow and which completely eliminates the use of the conventional peristaltic pump.

DESCRIPTION OF THE PRIOR ART

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials therein, is maintained on the polishing pad to modify the polishing characteristics of the polishing pad in order to enhance the polishing of the substrate.

The use of chemical mechanical polishing to planarize semiconductor substrates has not met with universal acceptance, particularly where the process is used to remove high elevation features created during the fabrication of microelectronic circuitry on the substrate. One primary problem which has limited the used of chemical mechanical polishing in the semiconductor industry is the limited ability to predict, much less control, the rate and uniformity at which the process will remove material from the substrate. As a result, CMP is labor intensive process because the thickness and uniformity of the substrate must be constantly monitored to prevent overpolishing or inconsistent polishing of the substrate surface.

One factor, which contributes to the unpredictability and non-uniformity of the polishing rate of the CMP process, is the non-homogeneous replenishment of slurry at the surface of the substrate and the polishing pad. The slurry is primarily used to enhance the rate at which selected materials are removed from the substrate surface. As a fixed volume of slurry in contact with the substrate reacts with the selected materials on the surface of the substrate, this fixed volume of slurry becomes less reactive and the polishing enhancing characteristics of that fixed volume of slurry is significantly reduced. One approach to overcoming this problem is to continuously provide fresh slurry onto the polishing pad. This approach presents at least two problems. Because of the physical configuration of the polishing apparatus, introducing fresh slurry into the area of contact between the substrate and the polishing pad is difficult. Providing a fresh supply of slurry to all positions of the substrate is even more difficult. As a result, the uniformity and the overall rate of polishing are significantly affected as the slurry reacts with the substrate.

The polishing process is carried out until the surface of the wafer is ground to a highly planar state. During the polishing process, both the wafer surface and the polishing pad become abraded. After numerous wafers have been polished, the polishing pad becomes worn to the point where the efficiency of the polishing process is diminished and the rate of removal of material from the wafer surface is significantly decreased. It is usually at this point that the polishing pad is treated and restored to its initial state so that a high rate of uniform polishing can once again be obtained.

In the conventional approach, the wafer is held in a circular carrier, which rotates. The polishing pads are mounted on a polish platen which has a flat surface and which rotates. The rotating wafer is brought into physical contact with the rotating polishing pad; this action constitutes the Chemical Mechanical Polishing process. Slurry is dispensed onto the polishing pad typically using a peristaltic pump. The excess slurry typically goes to a drain, which means that the CMP process has an open loop slurry flow. In addition, the conventional approach uses orbital motion where there is a relative motion at any point of the wafer that poses severe problems of non-uniformity across the die and across the wafer in addition to problems of planarity. Also, the conventional approach uses and dispenses with an excessive amount of slurry that adds significantly to the processing cost. There also is no method for exactly controlling slurry flow. The present invention addresses and solves the indicated problems. Since both the wafer and the polishing pad are rotating there exists a velocity differential across the wafer. This velocity differential wafer polishing uniformity and planarity suffer across the die and across the wafer. This limits the application of the conventional CMP approach especially in Shallow Trench Applications, copper damascene, etc., which are involved in sub-quarter micron technology modes.

FIG. 1 shows a Prior Art CMP apparatus. A polishing pad 20 is affixed to a circular polishing table 22 which rotates in a direction indicated by arrow 24 at a rate in the order of 1 to 100 m RPM. A wafer carrier 26 is used to hold wafer 18 face down against the polishing pad 20. The wafer 18 is held in place by applying a vacuum to the backside of the wafer (not shown). The wafer carrier 26 also rotates as indicated by arrow 32, usually in the same direction as the polishing table 22, at a rate on the order of 1 to 100 RPM. Due to the rotation of the polishing table 22, the wafer 18 traverses a circular polishing path over the polishing pad 20. A force 28 is also applied in the downward or vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26. Slurry 21 is deposited on top of the polishing pad 20.

FIG. 2 shows a typical Prior Art slurry delivery system. Slurry 21 of uniform chemical and mechanical composition is contained in the slurry vat 34 from where the slurry 21 is pumped by the diaphragm pump 36 in direction 38. The peristaltic pump 40 deposits controlled and intermittent amounts of slurry 21 onto the polishing pad 20 while the balance 44 of the slurry that had been pumped by the diaphragm pump 36 is returned to the slurry vat 34. The rate at which the slurry 42 is provided by the two pumps 36 and 40 can be under control of conditions of operation and environment such as type of surface being polished, rate of rotation of either the wafer 18 and/or the polishing table, etc.

U.S. Pat. No. 5,688,360 (Jairath) shows cylindrical and conical polishing pads.

U.S. Pat. No. 5,709,593 (Guthrie et al.) shows a slurry delivery system and slurry wiper bar.

U.S. Pat. No. 5,785,585 (Manfredi et al.) discloses a polishing pad conditioner with radical compensation.

U.S. Pat. No. 5,792,709 (Robinson et al.) shows a polishing pad disk.

U.S. Pat. No. 5,782,675 (Southwick) discloses an apparatus to recondition a polishing pad.

U.S. Pat. No. 5,650,039 (Talieh) discloses a polishing pad with grooves to deliver slurry.

U.S. Pat. No. 5,775,983 (Shendon et al.) teaches a conical roller to condition the polishing pad.

SUMMARY OF THE INVENTION

The present invention teaches an in-situ slurry distribution and concurrent pad conditioning process and apparatus. The novelty of the present invention is that the polishing pads are mounted on a cylindrical platform that consists of a pad/core arrangement, instead of the conventional flat platform on which the polishing pads are placed.

The cylindrical pad has motion in the X-Y-Z directions; the cylindrical pad in addition has rotational motion. The novelty of the present design consists of as unique pad/core design with the polishing pads mounted on the surface of the core. Evenly spaced openings are provided within the pad/core assembly for the location of slurry ports.

The center of the core is hollow; slurry is pumped through the center of the core and exits the core through the slurry ports to the polishing pads and the pad conditioners.

The present invention in addition incorporates a new slurry delivery arrangement. The slurry, which can consist of a combination of more than one type or composition of slurry, is pumped in the conventional manner (for instance using diaphragm pumps) and flows through an orifice-flow meter where the multi-component slurries are combined and pumped through a single tube mixing coil. The actual mixing of the different slurries occurs within the mixing coil. The mixed slurry flows through a rotating driver that rotates the pad/core combination.

In this way, a constantly renewed supply of fresh slurry can be provided to the wafers which are being polished thus eliminating previously experienced problems associated with stationary or used slurry. This aspect of the present invention is of particular importance for the polishing of metal surfaces.

Using this approach of the present invention, the slurry can be metered very accurately unlike the slurry flow of conventional applications where the peristaltic pump causes a great deal of irregularities in the flow of the slurry. In addition, the present invention allows for the complete elimination of the peristaltic pump.

As part of the present invention, a pad conditioner disc used. This disc is of the same shape as the pad/core assembly and fits snuggly around this assembly. The pad conditioner conditions the polishing pads at the same time that the polishing operation takes place. The friction between the pad conditioner and the pad/core assembly can be varied during and as part of the polishing process thus further adding a parameter of control for the polishing operation.

The method used for increasing the friction or pressure between the pad conditioner and the pad/core assembly can be of a number of designs, for instance air-actuated cylinders can be used for this purpose. This allows for very accurate control of this application parameter.

BRIEF DESCRIPTION OF THE DRAWINGS

FIGS. 1 and 2 show Prior Art polishing and slurry supply tools.

DETAILED DESCRIPTION OF THE PREFERRED EMBODIMENT

Figures 3A, 3B:
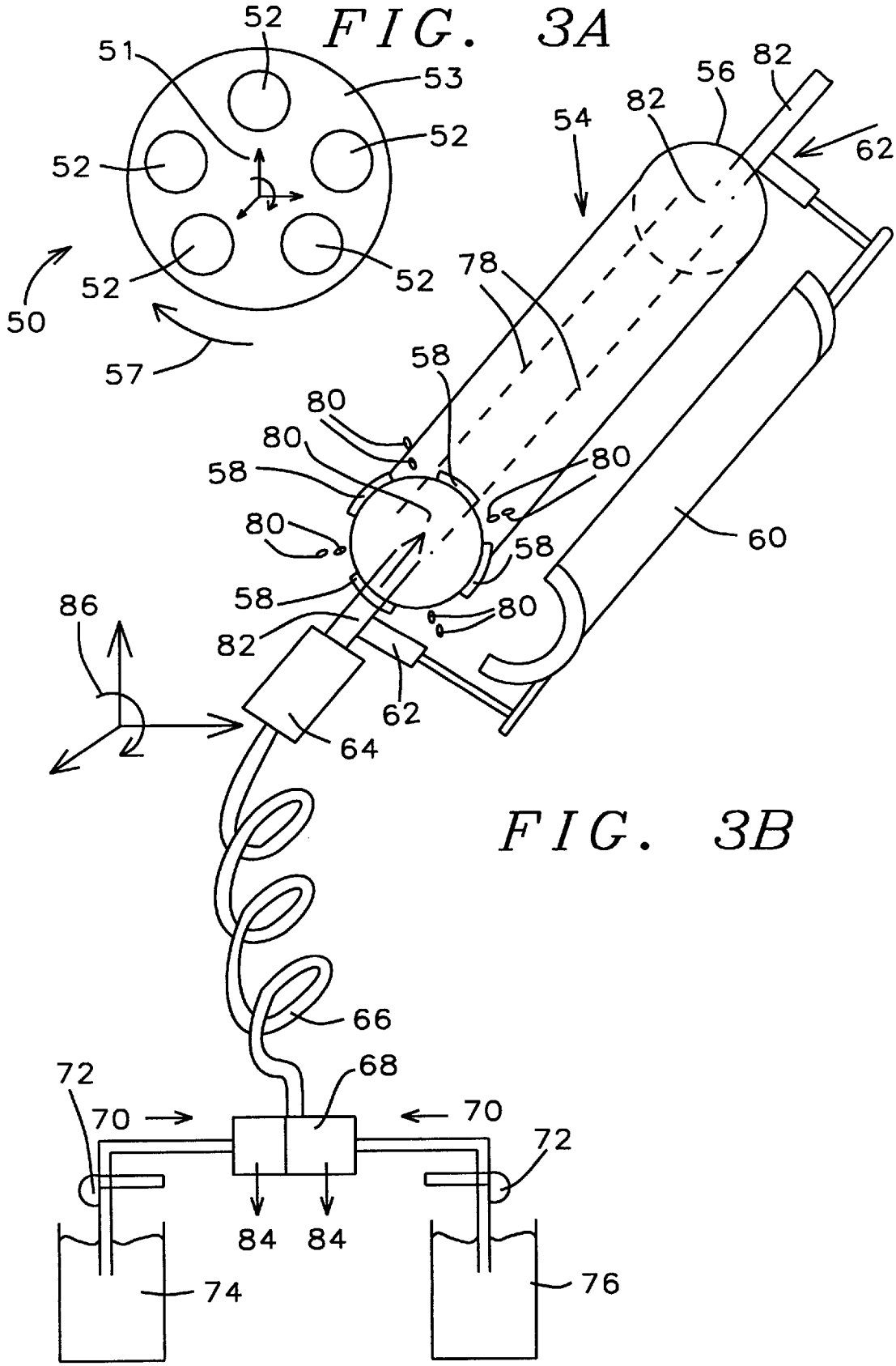
FIG. 3A and FIG. 3B show an overview of the implementation of the present invention.

Referring now specifically to FIG. 3*a,* there is shown an exploded view of the polishing apparatus of the present invention. The plan view 50 in the top left corner shows the positioning of the wafers 52 that are being polished with the wafer carrier 53. The diagram 51 at the center of this cross sectional view indicates that the wafer carrier 53 has freedom of motion in the X-Y-Z direction in addition to the rotating motion 57.

The pad/core assembly 54 is further detailed FIG. 3*b.* Mounted on the outside of the hollow core 56 and in parallel with this core is an arrangement of four polishing pads 58. The number of polishing pads provided in this manner is not limited to the number of four as shown in FIG. 3*b,* any number of pads can be used which best suits and satisfies the need of a particular application.

Adjacent to the pad/core assembly 54 is presented one pad conditioner disk 60. The number of pad conditioner disks that can be used within the scope of this invention can vary and is determined by optimum results obtained for a particular application of the present invention.

Air actuated cylinders 62 can be used to urge the pad/core assembly 54 toward the wafer carrier 53. By increasing the pressure by which the pad/core assembly 60 is urged toward the wafer carrier 53, the process of polishing the wafers 52 can be controlled.

The process of wafer polishing is as follows: the pad/core assembly 54 rotates around its axis 82 stimulated by the rotary actuator 64. The diagram 86 within this cross sectional view indicates that the pad/core assembly 54 has freedom of motion in the X-Y-Z direction in addition to the rotating motion. The direction of rotation of the pad/core assembly 54 is, within the scope of the present invention, not critical.

The wafers 52 that are to be polished are, in the conventional manner, affixed to the wafer carrier 53, the wafer carrier 53 also rotates around its axis, the direction of rotation 57 is, within the scope of the present invention, not critical.

The pad/core assembly 54 is mounted above and in close physical proximity to the wafers 52 affixed to the wafer carrier 53 such that the polishing pads 58 are in physical contact with the wafers 52 thus allowing the polishing pads 58 to polish the wafers 52.

While this polishing action is taking place, the polishing pad conditioner 60 is or can be brought into contact with the rotating polishing pads 58. This latter contact between the polishing pads 58 and the polishing pad conditioner disc 60 refreshes or conditions the polishing pads 58.

The number of polishing pad conditioners 60 that is mounted on the pad/core arrangement 54 may vary and is dictated by requirements of particular applications. It is clear from the above that a large part of the outside surface of core 56 can be covered with pad conditioners 60, care must be taken that the pad conditioners 60 do not physically interfere with the top surface of the wafer carrier 53.

The rotary driver 64 rotates that pad/core assembly 54 around its central axis 82. The rotary driver 64 can be of any conventional design; the design of the rotary driver 64 is not part of the present invention. Pumped through the rotary driver is the slurry 81 after it exits the slurry-mixing coil 66. The slurry is forced into the slurry-mixing coil from the slurry junction box 68. The slurry enters this box 68 from one or more sources of slurry, the rate at which this slurry from the various sources enters the junction vessel 68 is controlled at the entry points into the vessel by means of preset and adjustable openings 84 into the vessel 68.

Shown in FIG. 3*b* are two diaphragm pumps 72 that pump the slurry in direction 70, that is towards and into the slurry junction vessel 68. The slurry used for the polishing process is contained in the two slurry supply containers 74 and 76 which contain respectively slurry component 1 and slurry component 2. At the center of core 56 are provided channels or hollow zones 78 that run in the same direction as the axis 82 of the pad/core assemblage 54. These channels 78 are further connected to slurry ports (not shown in FIG. 3*b*) through which the slurry 80 is deposited and distributed to the polishing pads 58.

Figure 4A:
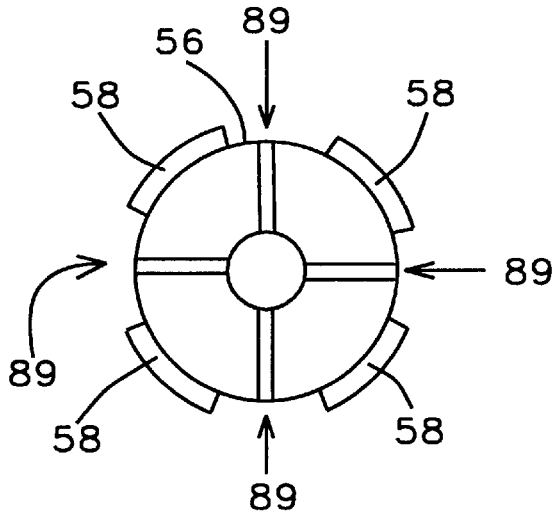
FIG. 4A and FIG. 4B show a cross sectional view of the pad/core assembly.

FIG. 4*a* shows a cross sectional view of the pad/core combination with a set of four polishing pads 58, the core 56 and the slurry ports 89.

Figure 4B:
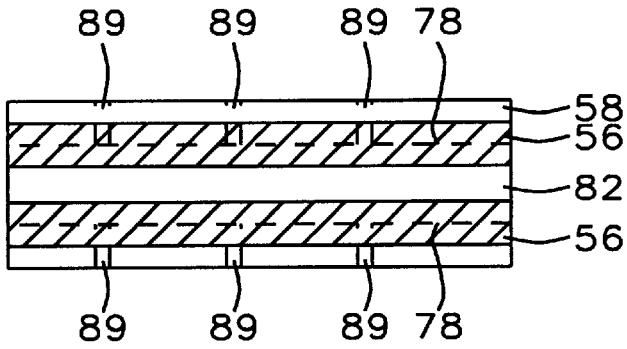

FIG. 4*b* shows a cross sectional view of the pad/core combination. The cross sectional view shows that the center 78 of the core 56 is hollow. The slurry ports 89 are also indicated.

The flow of the slurry is as follows: the slurry is forced into the hollow zones or channels 78 provided for this purpose in the core 56 by the rotary driver 64 and exits these channels 78 via the slurry ports 89. The core is mounted on the core shaft or axis 82, which in turn is connected to the rotary driver 64.

Figure 5:
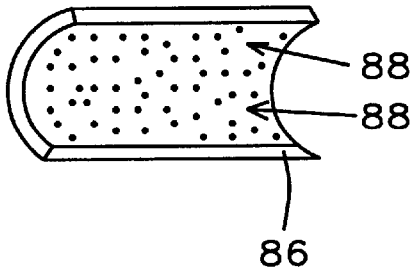
FIG. 5 shows a detailed view of the pad conditioner disk.

FIG. 5 shows the exploded view of the pad conditioner disc. The inside 88 of the conditioner disk is seeded with diamond in order to improve the effectiveness of the polishing pad renewal process. The conditioner disk itself (86) can be made using stainless steel or any other appropriate material.

From the foregoing it will be clear that, although a specific embodiment of the present invention has been described herein for purposes of illustration, various modifications to the present invention may be made without deviating from the spirit and scope of the present invention. Accordingly, the present invention is not limited except as by the appended claims.

What is claimed is:

1. A method for chemical mechanical planarization of a semiconductor wafers, comprising:

providing a platform for mounting semiconductor wafers;

providing a means for rotating said platform for mounting semiconductor wafers;

providing a cylindrical platform for mounting semiconductor polishing pads;

providing a means for rotating said cylindrical platform;

providing a cylindrical polishing pad arrangement;

providing a polishing pad conditioner arrangement;

providing a means for rotating said cylindrical polishing pad;

providing a means for varying pressure by which the cylindrical polishing pads are urged toward the semiconductor wafers;

providing a means for varying pressure by which the pad conditioner disks are urged toward the polishing pads;

providing a means for evenly distributing slurry within said cylindrical platform by providing a set of openings or channels provided within said cylindrical platform combined with slurry ports that match and are connected to said openings or channels and that exit to and are connected with the outside surface of said cylindrical platform and by further providing a means of entering said slurry into said cylindrical platform consisting of slurry pumped into said channels of said cylindrical platform by means of a rotary pump, said means for evenly distributing slurry within said cylindrical platform being a component of an apparatus for said chemical mechanical planarization; and planarizing said semiconductor wafer by chemical mechanical planarization.

2. The method of claim 1 wherein said platform for mounting said semiconductor wafers consists of a top surface or face of a wafer carrier.

3. The method of claim 1 wherein said means of rotating said wafer carrier consists of a rotary driver motor.

4. The method of claim 1 wherein said cylindrical platform for mounting semiconductor polishing pads consists of a cylinder mounted on a cylinder axis or shaft.

5. The method of claim 1 wherein said means for rotating said cylindrical platform consists of a rotary driver motor.

6. The method of claim 1 wherein said cylindrical polishing pad arrangement consists of polishing pads mounted on an outside surface of said cylindrical platform and in a direction of the axis of said cylindrical platform and consist of one polishing pad while said polishing pad has the same or approximately same length as the length of said cylinder.

7. The method of claim 1 wherein said polishing pad arrangement consists of polishing pads mounted on the outside surface of said cylindrical platform and in the direction of the axis of said cylindrical platform and consist of a multiplicity of polishing pads while said polishing pads have a length which may or may not be uniform but is shorter than the length of said cylindrical platform.

8. The method of claim 1 wherein said polishing pad arrangement consists of polishing pads mounted on the outside surface of said cylindrical platform and in the direction of the axis of said cylinder and consist of a multiplicity of polishing pads while said polishing pads have the same or approximately same length as the length of said cylindrical platform.

9. The method of claim 1 wherein said polishing pad arrangement consists of polishing pads mounted on the outside surface of said cylindrical platform and in the direction of the axis of said cylindrical platform and consist of a multiplicity of polishing pads while said polishing pads have a length which may or may not be uniform but which is shorter than the length of said cylindrical platform.

10. The method of claim 1 wherein said polishing pad conditioner arrangement consists of one concave disk with an inner surface that matches with and has the same profile as the outer surface of said polishing pads and that is mounted on the outside of said polishing pad arrangement.

11. The method of claim 10 wherein said pad conditioner arrangement consists of a multiplicity of said concave disks mounted on the outside of said polishing pad arrangement.

12. The method of claim 1 wherein the means of varying said pressure by which said cylindrical pad conditioner disks are urged toward said cylindrical polishing pads consists of air activated cylinders attached to the extremities of said polishing pads.

13. The method of claim 1 wherein the method of varying the pressure by which said polishing pads are urged toward said semiconductor wafers consists of air activated cylinders attached to the extremities of said polishing pads.

14. The method of claim 1 wherein providing the means for evenly distributing slurry to the outside surface of said rotating cylindrical platform comprises a method for mixing multiple slurries for chemical mechanical planarization of a semiconductor wafers, comprising:

providing a means for mixing multiple slurries consisting of a mixing coil through which one or more slurry components are pumped using conventional pumping techniques;

providing a means for controlling rate of slurry flow consisting of adjusting slurry-flow control or orifice settings mounted within the slurry supply flow; and providing a means for entering a multiplicity of slurries consisting of a multiplicity of slurry vats or containers that contain said slurry components and from which said slurry components are pumped using conventional pumping techniques via said preset orifices into said slurry mixing coil from where said mixed slurry is urged by said rotary motor to said channels within said rotary cylindrical platform.

15. A method for chemical mechanical planarization of a semiconductor wafers, comprising:

providing a platform for mounting semiconductor wafers;

providing a means for rotating said platform for mounting semiconductor wafers wherein said means consists of a rotary activator;

providing a cylindrical platform for mounting semiconductor polishing pads;

providing polishing pads to fit and match said cylindrical platform for mounting semiconductor polishing pads;

providing a means for rotating said cylindrical platform wherein said means consists of a rotary activator;

providing a polishing pad arrangement wherein said polishing pad arrangement is one or more polishing pads mounted on the outside periphery of said cylindrical platform for mounting polishing pads;

providing a polishing pad conditioner arrangement wherein said polishing pad conditioner consists of one or more concave stainless steel constructs where the profile of the inside surface of said constructs is the same as the outside profile of the cylindrical platforms for mounting said semiconductor polishing pads and where the inside surface of said polishing pad conditioners is covered with an abrasive material such as diamond;

providing a means for rotating said cylindrical polishing pad wherein said means consists of a rotary activator;

providing a means for varying the pressure by which the polishing pads are urged toward the semiconductor wafers wherein said means consists of air activated cylinders mounted on the extremities of said platform for mounting said polishing pads;

providing a means for varying the pressure by which the pad conditioner disks are urged toward the polishing pads wherein said means consists of air activated cylinders mounted on the extremities of said platform for mounting said pad conditioner disks;

providing a means for evenly distributing slurry across the surface of said polishing pads wherein said means consists of a slurry supply system that pumps slurry into hollow channels within the polishing pad platform from where the slurry is released to the surface of the polishing pads by means of slurry ports that connect said channels with said the surface of said platform for mounting said polishing pads;

providing a means for entering said slurry into said cylindrical platform wherein said means consists of a pump contained within the rotary activator that rotates said cylindrical platform;

providing a means for mixing multiple slurries wherein said means consists of a mixing coil into which one or more slurry components are pumped and within which said slurry components are mixed by means of rotary propulsion;

providing a means for controlling the rate of slurry flow wherein said means is the setting of openings that provide control over the flow of a multiplicity of slurry components into a slurry supply vat into which one or more slurry components can be entered;

providing a means for entering a multiplicity of slurries wherein said means consists of a multiplicity of slurry supply reservoirs; and planarizing said semiconductor wafer by chemical mechanical planarization.

* * * * *